US005178286A

United States Patent [19]

Allison, III

[11] Patent Number: 5,178,286

[45] Date of Patent: Jan. 12, 1993

[54] MULTI PURPOSE DISPLAY

[76] Inventor: Harvey O. Allison, III, 2716 W. 96th St., Bloomington, Minn. 55431

[21] Appl. No.: 719,380

[22] Filed: Jun. 24, 1991

[51] Int. Cl.[5] ..... A47G 7/00

[52] U.S. Cl. ..... 211/71; 47/39; 211/205; 248/159; 248/165; 248/188.4

[58] Field of Search ..... 47/39; 211/71, 33, 196, 211/103, 205, 126, 133; 248/295.1, 125, 163.2, 150, 188.4, 158, 159, 176

[56] References Cited

U.S. PATENT DOCUMENTS

| | | | |
|---|---|---|---|
| D. 6,580 | 4/1873 | Robertson | D6/405 |
| 37,070 | 12/1862 | Crawford | 108/94 |
| 47,664 | 5/1865 | Sheldon | 47/39 X |
| 113,035 | 3/1871 | Erkson | 47/39 X |
| 214,061 | 4/1879 | Stearns | 47/67 |
| 317,443 | 5/1885 | Cunningham | 211/77 |
| 342,476 | 5/1886 | Swartwout | 211/75 |
| 554,661 | 2/1896 | Doolittle | 108/105 |
| 577,230 | 2/1897 | Boyd | 47/39 |
| 699,154 | 5/1902 | DeForce | 47/39 |
| 1,043,387 | 11/1912 | Astruck | 248/150 |
| 1,043,622 | 11/1912 | Miles | 211/74 |
| 1,369,315 | 2/1921 | Ankers | 248/153 |
| 2,003,986 | 6/1935 | Witthuhn | 47/39 |
| 2,861,764 | 11/1958 | Fisher | 47/39 X |
| 3,244,128 | 4/1966 | Rogalski et al. | 211/133 X |
| 4,453,640 | 6/1984 | Cillario | 211/133 |
| 4,511,157 | 4/1985 | Wilt, Jr. | 248/125 X |
| 4,520,981 | 6/1985 | Harrigan | 248/125 X |
| 4,865,283 | 9/1989 | Parker | 211/205 X |

*Primary Examiner*—Carl D. Friedman
*Assistant Examiner*—Derek J. Berger
*Attorney, Agent, or Firm*—Palmatier, Sjoquist & Helget

[57] ABSTRACT

A rack for the display of objects such as flower pots, candy bowls, and fruit baskets. The rack includes arms which extend from a central shaft in a staggered fashion and which include disk-shaped bases on their distal ends for supporting the objects. Furthermore, the arms are slidable on the shaft such that the bases are vertically adjustable. For storage and transport, the arms and legs may be readily disconnected from the central shaft, and the central shaft itself may be broken down into pieces.

18 Claims, 3 Drawing Sheets

MULTI PURPOSE DISPLAY

The present invention relates to a rack for the display of objects such as flower pots, candy bowls, and fruit baskets on arms extending from a central shaft and, more particularly, to such racks wherein the arms are staggered and vertically adjustable on the shaft, and wherein the rack may be broken down to a relatively compact package.

BACKGROUND OF THE INVENTION

Flower pots, candy bowls, and fruit baskets are objects that have a number of common features. These features include relatively heavy weight, and a relatively great height and width. Furthermore, each of these objects may be formed in a variety of odd sizes and shapes. Still further, each of these objects are typically highly colorful.

SUMMARY OF THE INVENTION

A feature of the present invention is the provision in a rack with a central shaft and arms extending from the shaft in staggered fashion for the display of objects, of the arms being readily disconnectable from the shaft and the shaft itself being capable of being disassembled into pieces to break the rack down into a relatively compact package for storage and transport.

Another feature is the provision in such a rack, of the arms being vertically slidable and adjustable on the rack to be positioned at a predetermined height such that the rack may be customized to the type of object being displayed.

Another feature is the provision in such a rack having legs mounted on the lower end of the central shaft for supporting the shaft relative to a surface, of the legs being readily disconnectable from the central shaft for storage and transport.

Another feature is the provision in such a rack, of the distal end of the arms having bases for supporting the objects, and the bases being formed in the shape of a disk to accommodate a number of objects as well as oversized objects and to provide rounded, blunt edges for safety purposes.

Another feature is the provision in such a rack, of the rack being essentially entirely formed from a metal such as steel to add stability to the rack which typically displays heavy objects and is intended for use in stores such as grocery stores where the rack may be bumped by grocery carts.

An advantage of the present invention is stability for the display of heavy objects. One of the features contributing to this advantage is the staggered manner in which the arms extend to distribute weight 360° about the central shaft of the rack. Another feature contributing to this advantage is the heavy material from which the rack is formed. The rack maintains itself upright even when a number of objects are placed unproportionately on the rack such as on only one side of the rack.

Another advantage is the maximum use of space for the display of tall objects. One feature contributing to this advantage is the staggered manner in which the bases are disposed such that tall objects may extend between objects being displayed on the next highest level.

Another advantage is that the present invention may be readily transported or stored. Some features contributing to this advantage are the readily disconnectable arms and legs, and the readily disassemblable central shaft.

Another advantage is safety. One of the features contributing to this advantage is the heavy weight of the rack to, for example, prevent the rack being tipped when bumped by a shopping cart. The great mass of the rack may also absorb the impact of such an impact instead of transmitting the force of the impact to its attendant objects. Another feature contributing to this advantage is the rounded peripheral edge of the disk-shaped bases to prevent cuts or abrasions to the hands, fingers, and face.

Another advantage is that the objects being displayed are accessible and readily removed from the rack without disturbing the other objects on display.

DETAILED DESCRIPTION OF THE PREFERRED EMBODIMENT

Figure 1:
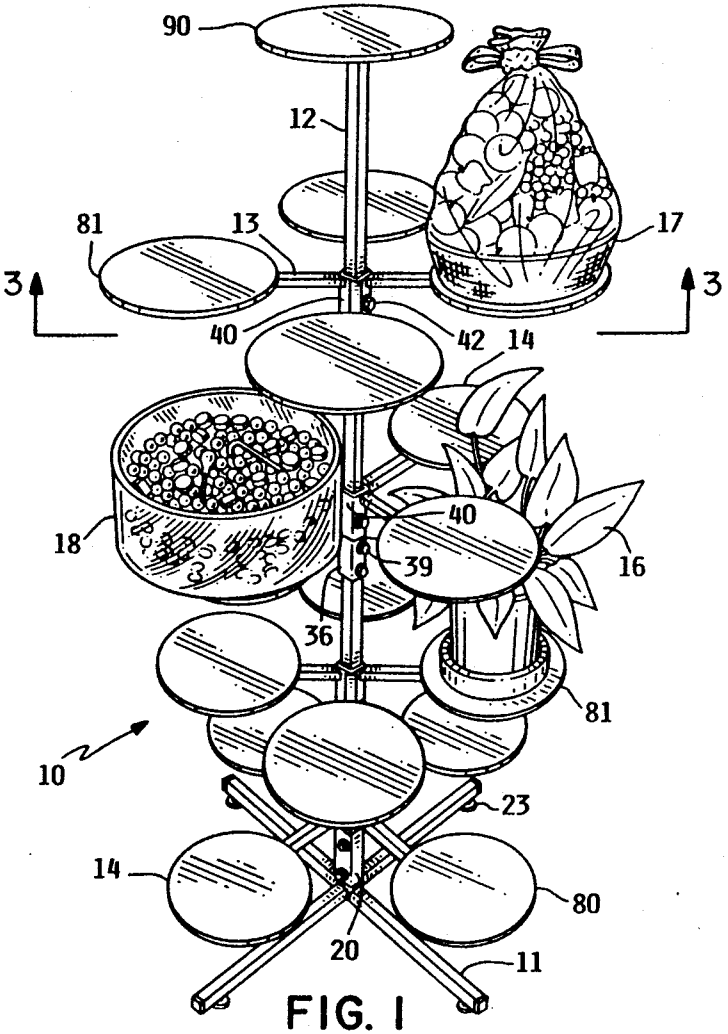
FIG. 1 is a perspective view of the present display rack.

As shown in FIG. 1, the present display rack is indicated in general by the reference numeral 10. It includes as its principal components a set of legs 11 mounting a central support or shaft 12, which in turn mounts four sets of arms 13 with bases 14. The bases 14 typically support floral arrangements or flower pots 16, fruit baskets 17, candy bowls 18, and other objects of relatively great weight, height and width and which may be formed in a variety of sizes and shapes.

Figure 2:
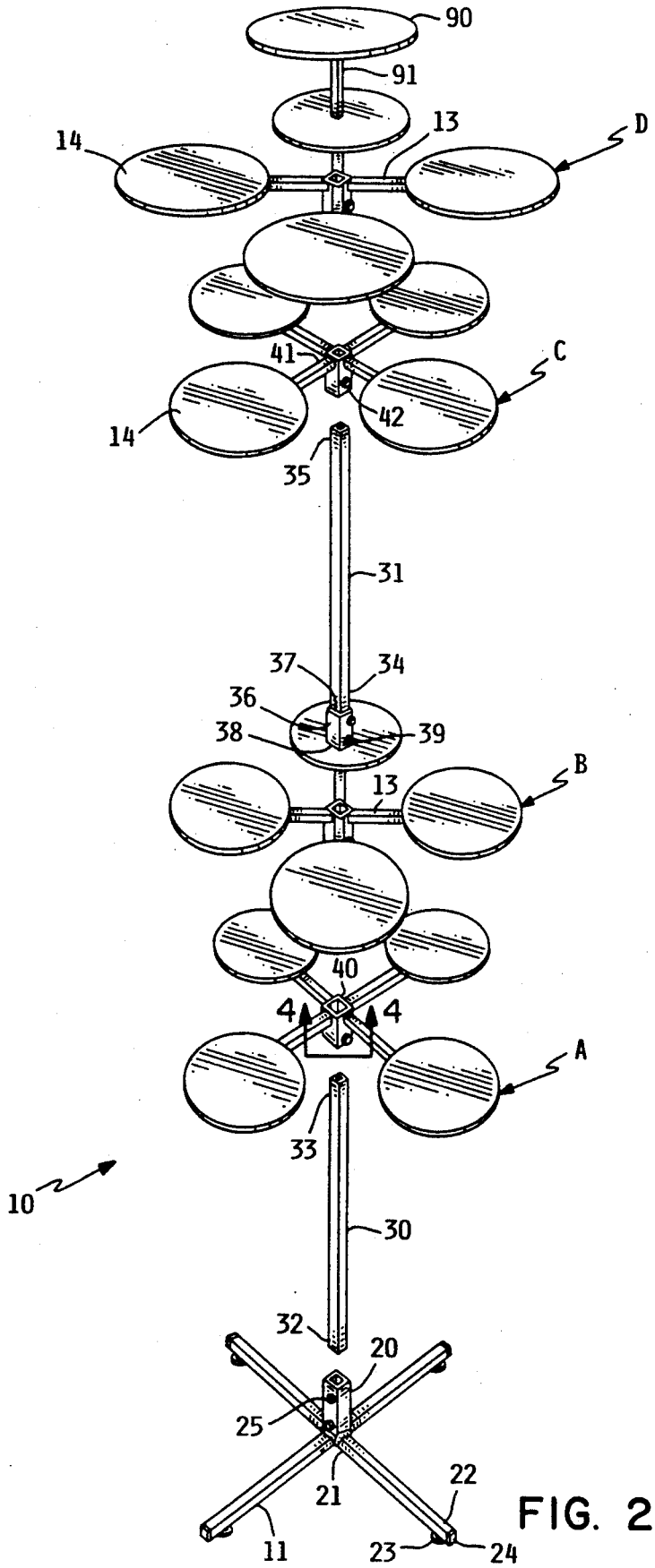
FIG. 2 is an exploded perspective view of the display rack of FIG. 1.

As shown in FIGS. 1 and 2, the set of four legs 11 are rigidly affixed, such as by welding, to a tubular mount or joint 20. The legs 11 are affixed at right angles relative to each other and relative to the mount 20 to extend generally horizontally. The proximal end 21 of each of the legs 11 is affixed to the mount 20 and a distal end 22 of each of the legs 11 includes a leveling means or threaded, headed pin 23 extending downwardly at a right angle from the lower surface of the distal end 22 for leveling the rack 10 such as when the rack 10 is placed on an uneven surface. Each of the legs 11 is raised or lowered by turning its respective pin connector 23, whose head engages the surface on which the rack 10 is placed. Each of the legs 11 is tubular and includes a metal cap 24 for capping or sealing the distal end 22. The mount 20 is tubular and square in cross section and includes a pair of threaded pin connectors 25 for engaging the central support 12 and for fixing the central support 12 relative to the mount 20. An inner end of each of the pin connectors 25 brings pressure to bear on the outer surface of the support 12 to fix the support 12 in the mount 20. It should be noted that some tilting of the support 12 about a horizontal axis may be accomplished by turning one of the pin connectors 25 to a greater degree than the other pin connector 25. The pin connectors 25 permit the legs 11 to be readily disconnectable from the support 12.

The central support 12 is centrally oriented relative to the legs 11 and arms 13, and is elongate, rigid and extends generally vertically relative to the surface on which the rack 10 is placed. The support 12 may be disassembled into lower and upper tubular support portions 30, 31 of generally equal length for ease of storage and transport. The lower support portion 30 includes a lower end 32 which engages the mount 20, and an upper end 33. The upper support portion 31 includes respective lower and upper ends 34, 35.

The lower end 34 of the upper support portion 31 includes a tubular joint or piece 36 for fixing the support portions 30, 31 relative to each other to form the central support 12. The joint 36 includes an upper edge portion 37 which is rigidly affixed such as by welding to the lower end 34 of the upper support portion 31. The lower support portion 30 is insertable into an open lower end 38 of the joint 36 and is fixed therein via a pair of threaded pin connectors 39. When fixed in joint 36, it may be desirable to abut the upper end 33 of the lower support portion 30 against the lower end 34 of the upper end support portion 31 to directly transfer the load of the upper support portion 31 to the lower support portion 30. It should be noted that the upper support portion 31 may be tilted relative to the lower support portion 30 by turning one of the pin connectors 39 to a greater degree, as some play exists between the joint 36 and upper end 33. It should further be noted that the pin connectors 39 may be readily turned to permit the support portions 30, 31 to be readily disconnected from each other.

Figure 3:
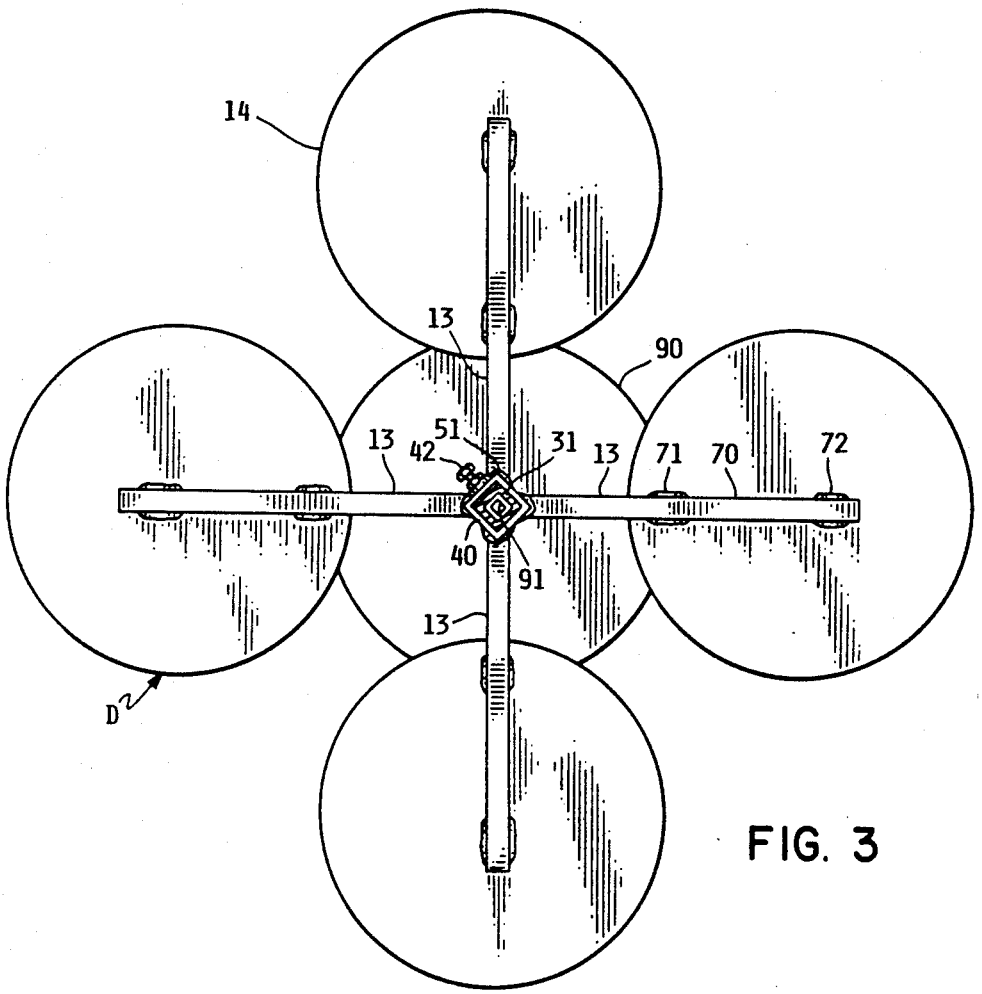
FIG. 3 is a detail section view at lines 3—3 of FIG. 1.
Figure 4:
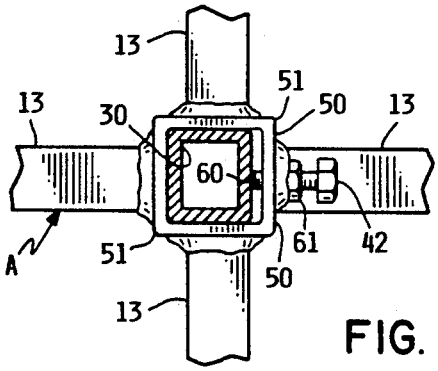
FIG. 4 is a detail view at lines 4—4 of FIG. 2 with a portion of the central shaft shown in section.
Figure 6:
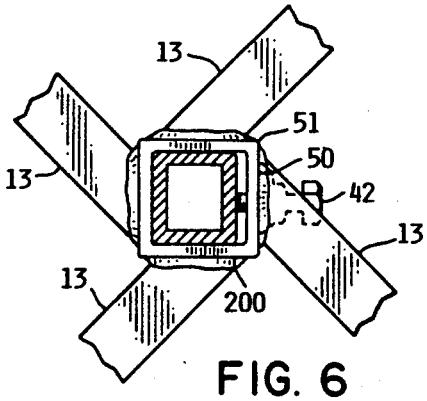
FIG. 6 is a detail section view of an alternate embodiment of the present display rack.

Each of the sets of arms 13 includes four arms 13 extending at generally right angles from each other and from a tubular section or joint 40. Each of the arms 13 includes a proximal end 41 rigidly affixed such as by welding to the joint 40. The joint 40 is square in cross section and tubular such that one of the support portions 30, 31 is readily insertable into the joint 40 and such that the joints 40 and their respective arms 13 and bases 14 are vertically slidable relative to the support portions 30, 31 and readily disconnectable therefrom. Each of the joints 40 includes a threaded pin connector 42 for engaging the outer surface of one of the support portions 30, 31 for fixing its respective arm 13 and base 14 at a desired height or altitude on the elongate support 12. It should be noted that some play exists between the joints 40 and their respective support portions 30, 31 to provide for a certain amount of independent leveling of the bases 14 relative to the support 12. As shown in FIGS. 3, 4, and 6, and as the tubular sections 40 are slightly greater in width than the central support 12, such tubular sections or joints 40 are not rotatable relative the square tubular support portions 30, 31 of the central support 12 about a vertical axis of the support 12.

As shown in FIGS. 3 and 4, each of the joints 40 includes four faces 50 and four corner portions 51. As shown in FIGS. 2 and 4, the arms 13 of two sets of arms designated by the reference letters A and C extend from the faces 50 of the their respective joints 40. As shown in FIGS. 2 and 3, the arms 13 of the remaining two sets, designated by reference letters B and D extend from the corner portions 51 of the respective joints 40. Accordingly, immediately adjacent sets of arms 13 are staggered to permit relatively tall objects such as floral arrangements or fruit baskets to protrude between the bases 14 of the next highest set of arms 13.

As shown in FIG. 4, the pin connector 42 of the joints 40 include an inner end 60 for engaging the outer surface of one of the support portions 30, 31. The pin connector 42 threadedly engages a nut 61 welded to the outer surface of joint 40. The pin connector 42 may also threadedly engage the wall portion of the joint 40 which forms the face 50. It should be noted that pin connectors 25 and 39 operate in a similar fashion.

As shown in FIGS. 1, 2 and 3, each of the arms 13 includes a distal end portion 70 to which one of the bases or platforms 14 are rigidly affixed such as by welding at two locations 71, 72. Each of the bases 14 are formed in the shape of a disk with rounded blunt edges for safety purposes. As adjacent arms 13 are staggered relative to each other, the sets of bases 14 are also staggered relative to their immediately higher and lower sets. It should be noted that, although upwardly extending retainer lips or flanges may be disposed on the circumferential edges of the bases 14, such flanges are not desirable so as to permit the bases to accommodate a wide variety of objects which may have widths greater than the diameter of the base 14. If desired, tape with adhesive on both sides may be used to secure an object on one of the bases 14.

Each of the bases 14 of the lowermost set of bases designated by the reference letter A includes an outermost edge portion 80 which is vertically aligned with one of the caps 24 of the leg distal ends 22. The next three highest sets of bases B, C and D include outermost edge portions 81 which are vertically aligned with each other and which are set inwardly relative the outermost edge portion 80. In other words, the bases 14 of the lowermost set A are disposed at a greater distance from each other than the bases of the next three highest sets B, C and D. Accordingly, each of the arms 13 of the lowermost set A may have a greater length than arms 13 of the next three highest sets B, C and D.

An uppermost base or platform 90 includes an axial stem 91 for being inserted in the upper open end 35 of the upper support portion 31. The stem 91 is tubular and square in cross section and is readily slidable out of the upper support portion 31. The uppermost base 90 is formed in the shape of a disk.

The rack 10 is relatively heavy as the legs 11, support 12, arms 13, bases 14, platform 90, stem 91, and joints 20, 36 and 40 are formed of steel. This weight, along with the staggered manner in which the arms 13 and bases 14 are disposed, lends stability to the rack 10. The rack 10 typically weighs 60 pounds, is 60 inches in height, occupies only about 4.5 feet of floor space, and may be stored in a box having dimensions of 29 inches by 26 inches by 8.5 inches.

In operation, the display rack 10 is readily assembled by inserting the lower support portion 30 into the mount 20 and then tightening the pin connectors 25. The lowermost set of arms 13 and bases 14, designated by the reference letter A, is then slid onto the lower support portion 30 and its joint 40 is typically brought to engage or rest upon the mount 20, and the pin connector 39 of this joint 40 is then tightened. The next highest set of arms 13 and bases 14, designated by the reference letter B, is then slid onto the lower support portion 30 and fixed at a desired height or altitude thereon by tightening the pin connector 39 of its respective joint 40. The upper support portion 31 is then fixed to the lower support portion 30 via the joint 36. The next highest set of arms 13 and bases 14, designated by reference letter C, is then slid onto the upper support portion 31 until its respective joint 40 engages or rests upon joint 36, as seen in FIG. 1, and its respective pin connector 42 is then tightened. The next highest set of arms 13 and bases 14, designated by the reference letter D, is then slid onto the upper support portion 31 and fixed at a desired height via its respective pin connector 42. The uppermost platform 90 is then connected to the rack 10 by insertion of the stem 90 in the upper open end 35 of the upper support portion 30. Leveling pins 23 may then be turned to level the display rack 10.

After the display rack 10 has been assembled, the floral arrangements 16, fruit baskets 17, or candy bowls 18 or other objects may be placed on the bases 14 and 90. Top portions of the taller objects may extend between bases 14 of the next highest set as adjacent sets of bases are staggered radially from the central support 12. Since the rack 10 is essentially completely formed of steel, the rack 10 tends to resist impacts such as from shopping carts. Moreover, upon the display rack 10, the objects are accessible and may be lifted from the rack 10 without disturbing other objects. Furthermore, the rounded, blunt edges, of the bases 14 minimize the risk of cutting fingers, hands and faces.

The steps for disassembly of the display rack 10 are reversed from the steps for assembly. Disassembly is relatively easy as stem 91 is readily removed, and as pin connectors 25, 39 and 42 are readily loosened. When disassembled, the rack 10 may be stored or transported in a package or box with a width, height or length no greater than the length of one of the support portions 30.

Figure 5:
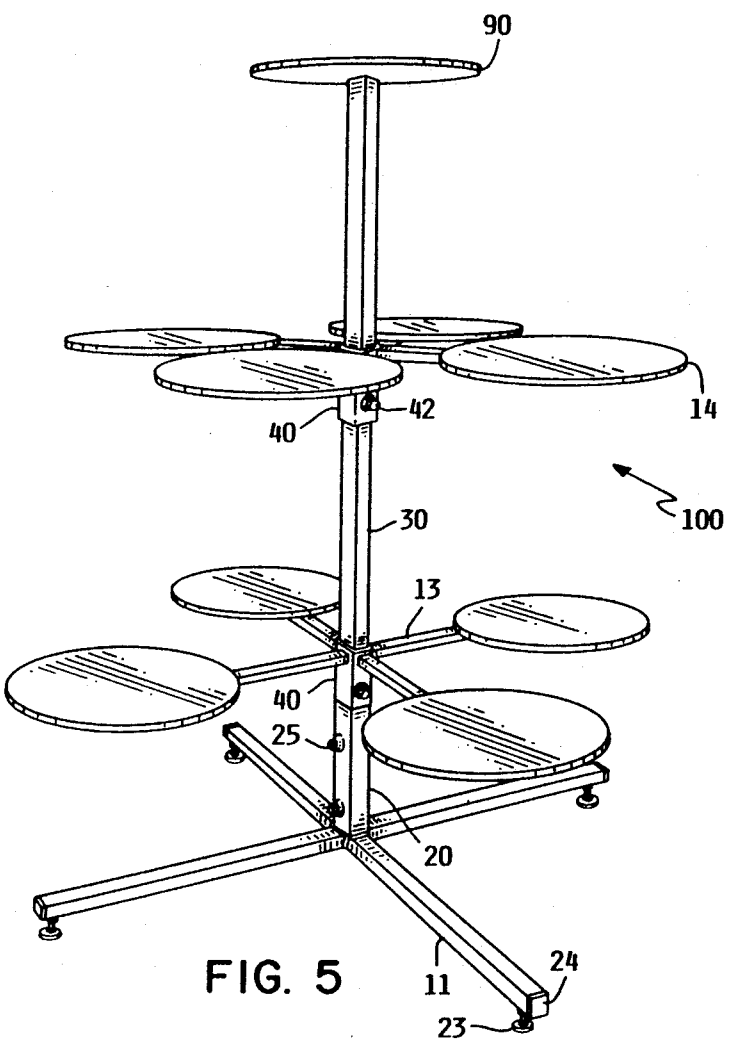
FIG. 5 is a perspective view of an alternate embodiment of the present display rack.

In another embodiment of the invention as shown in FIG. 5, an alternate display rack 100 includes only the lower support portion 30. The stem 91 of the upper platform 90 is inserted into the upper open end 33 of the lower support portion 30. If desired, all sets of legs and bases A, B, C and D may be slid onto the lower support portion 30 of the display rack 100.

In another embodiment of the invention as shown in FIG. 6, an alternate tubular section or joint 200 includes staggered arms 13 which rigidly extend at approximately a 45° angle from faces 50 of the joint 200. Each of the sets B and D may include the joint 200 or the joint 40 previously described where the staggered arms extend from the corner portions 51.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A rack for the display of a plurality of relatively heavy objects, comprising:

a) a central, elongate, rigid, generally vertically extending support having upper and lower ends and being tubular and generally square in cross section;

b) a set of legs extending from the lower end of the support for supporting the rack relative to a surface, the set of legs being readily disconnectable from the support, each of the legs including a distal end portion which includes leveling means extending downwardly therefrom for adjusting the altitude of its respective leg relative to the other legs for leveling the bases;

c) first, second, third, and fourth sets of arms extending from the support above the legs, each of the arms having a distal end portion, each of the sets of arms being readily disconnectable from the support, each of the sets of arms being disposed at an altitude different each of the other sets of arms, each of the sets of arms extending from the support in a staggered fashion relative to each of the other adjacent sets of arms, each of the sets of arms being generally vertically slidable on the support, each of the sets having at least two arms;

d) a base mounted on each of the distal end portions of the arms for supporting the objects, each of the bases being a disk;

e) the support being formed of at least two elongate support portions, each of the support portions being of substantially lesser length than the support, the support portions being readily disconnectable from each other whereby the rack may be broken down to a relatively compact package for storage and transport and;

f) a pair of tubular sections, each of the tubular sections being generally square in cross section, each of the tubular sections being slightly greater in width than the elongate support such that the elongate support is insertable in each of the tubular sections and to prevent the tubular sections from being rotated relative to the elongate support about a vertical axis, each of the sets of arms being rigidly affixed to one of the tubular sections, and each of the tubular sections further comprising means for fixing each of the tubular sections at a predefined altitude on the elongate support whereby a stable rack is provided.

2. The rack of claim 1, and further comprising a third set of arms extending from the support at an altitude different from the first and second sets of arms, the third set of arms extending from the support in a staggered fashion relative to any other sets of arms to which it is adjacent, the third set of arms being readily disconnectable from the support, each of the arms of the third set having a distal end portion for mounting one of the bases.

3. The rack of claim 2, and further comprising a fourth set of arms extending from the support at an altitude different from the first, second, and third sets of arms, the fourth set of arms extending from the support in a staggered fashion relative to any other sets of arms to which it is adjacent, the fourth set of arms being readily disconnectable from the support, each of the arms of the fourth set having a distal end portion for mounting one of the bases.

4. The rack of claim 1, and further comprising an uppermost platform mounted on the upper end of the elongate support for supporting an object, the uppermost platform being readily disconnectable from the elongate support, the uppermost platform and the elongate support sharing a common axis.

5. The rack of claim 4, wherein the uppermost platform is formed in the shape of a disk and includes a stem, the stem being insertable in the tubular support.

6. The rack of claim 1, wherein the support portions are tubular and square in cross section and each of the support portions includes two ends, and one of the ends of one of the support portions including a tubular piece square in cross section, the tubular piece being slightly greater in width than each of the support portions such that the other end of the other support portion is insertable in the tubular piece to form the elongate support and such that the support portions may engage each other, the tubular piece including means for fixing the support portions relative to each other.

7. The rack of claim 1, and further comprising a tubular mount square in cross section, the tubular mount being slightly greater in width than the elongate support such that the lower end of the elongate support is insertable in the tubular mount for mounting the elongate support, the set of legs extending from the tubular mount, the tubular mount including means for fixing the elongate support in the mount.

8. The rack of claim 1, wherein the support portions include upper and lower support portions connectable to each other, the upper support portion including a lower end portion and the lower support portion including an upper end portion, the lower and upper end portions abutting each other when connected to provide for load transfer from the upper support portion to the lower support portion.

9. The rack of claim 1, wherein each of the bases is formed in the shape of a disk.

10. The rack of claim 1, wherein each of the arms extends generally horizontally from the support.

11. The rack of claim 1, wherein each of the legs extends generally horizontally from the support.

12. The rack of claim 1, wherein the support arms, legs and bases are formed of metal to lend stability to the rack for supporting relatively heavy objects.

13. The rack of claim 12, wherein the metal is steel.

14. The rack of claim 1, wherein each set of arms comprises four arms.

15. The rack of claim 1, wherein the set of legs comprises four legs.

16. A rack for the display of a plurality of relatively heavy objects, comprising:

a) a central, elongate, rigid, generally vertically extending support having upper and lower ends;

b) a set of legs extending from the lower end of the support for supporting the rack relative to a surface, the set of legs being readily disconnectable from the support, each of the legs including a distal end portion which includes leveling means extending downwardly therefrom for adjusting the altitude of its respective leg relative to the other legs for leveling the bases;

c) first, second, third and fourth sets of arms extending from the support above the legs, each of the arms having a distal end portion, each of the sets of arms being readily disconnectable from the support, each of the sets of arms being disposed at an altitude different from each of the other sets of arms, each of the sets of arms extending from the support in a staggered fashion relative to the other adjacent sets of arms, each of the sets of arms being generally vertically slidable on the support and nonrotatable about a vertical axis of the elongate support, each of the sets of arms having at least four arms;

d) a plurality of bases mounted on the distal end portions of the arms for supporting the objects, each of the bases being formed in the shape of a disk; and e) the support being formed of at least two elongate support portions, each of the support portions being of substantially lesser length than the support, the support portions being readily disconnectable from each other whereby the rack may be broken down to a relatively compact package for storage and transport.

17. A rack for the display of a plurality of relatively heavy objects, comprising:

a) a central, elongate, rigid, tubular, generally vertically extending support having upper and lower ends, the support being formed of at least two elongate portions, each of the support portions being of substantially lesser length than the support, each of the support portions being tubular and generally square in cross section, one of the support portions including a tubular piece generally square in cross section and the other support portion being insertable into the tubular piece, the tubular piece including a pin connector for fixing the support portions relative to each other and permitting the support portions to be readily disconnectable, the support portions abutting each other when connected to provide for load transfer from one support portion to the other support portion;

b) a set of at least four legs extending from the lower end of the support for supporting the rack relative to a surface, the set of legs including a central tubular mount generally square in cross section for mounting the lower end of the elongate support, the tubular mount including a pin connector for fixing the tubular mount relative to the elongate support, each of the legs extending generally linearly and horizontally from the tubular mount and having a distal end which includes a threaded pin connector with a head adjustable in height for leveling the rack;

c) at least four sets of arms extending generally linearly and horizontally from the support, each of the arms having proximal and distal end portions, each of the sets of arms being readily disconnectable from the support, each of the sets of arms extending from the support in a staggered fashion relative to any other sets of arms to which it is adjacent, each of the sets of arms being disposed at an altitude different from the other sets of arms, each of the sets of arms including a central tubular section generally square in cross section to which their respectively proximal ends are rigidly affixed, each of the central tubular sections being slightly greater in width than the support portions such that the sets of arms are vertically slidable on the support portions and to prevent rotation of the tubular sections relative to the support portions about a vertical axis, each of the central tubular sections including a pin connector for fixing its respective set of arms relative to the support and such that each of the sets of arms are readily disconnectable from the support, each of the sets of arms comprising four arms;

d) a plurality of horizontal bases mounted on the distal end portions of the arms for supporting the objects, each of the arms mounting one of the bases, each of the bases being formed in the shape of a disk;

e) an uppermost horizontal platform mounted on the upper end of the elongate support for supporting an object, the uppermost platform being formed in the shape of a disk and including a stem extending axially downwardly from the platform, the stem being insertable in the upper end of the tubular support and readily disconnectable therefrom; and f) the support, arms, legs, bases, platform, tubular pieces, sections, and mount being formed of steel to lend stability to the rack for supporting relatively heavy objects; whereby the rack may be broken down to a relatively compact package for storage and transport.

18. A rack for the display of a plurality of relatively heavy objects, comprising:

a) a central, elongate, rigid, generally vertically extending support having upper and lower ends;

b) a set of legs extending from the lower end of the support for supporting the rack relative to a surface, the set of legs being readily disconnectable from the support, each of the legs including a distal end portion;

c) first, second, third and fourth sets of arms extending from the support above the legs, each of the arms having a distal end portion, each of the sets of arms being readily disconnectable from the support, each of the sets of arms being disposed at an altitude different from each of the other sets of arms, each of the sets of arms extending from the support in a staggered fashion relative to the other adjacent sets of arms, each of the sets of arms being generally vertically slidable on the support and nonrotatable about a vertical axis of the elongate support, each of the sets of arms having at least four arms;

d) a plurality of bases mounted on the distal end portions of the arms for supporting the objects, each of the bases being formed in the shape of a disk, each of the arms mounting one of the bases;

e) an uppermost platform being formed in the shape of a disk and being mounted on the upper end of the elongate support, the platform including an axial downwardly extending stem for insertion into the upper end of the support, the stem being readily removable from the upper end of the support; and f) leveling means on the distal end portions of each of the legs for leveling the rack; whereby the rack may be broken down to a relatively compact package for storage and transport.

* * * * *